US006855071B2

(12) United States Patent
Endo et al.

(10) Patent No.: US 6,855,071 B2
(45) Date of Patent: Feb. 15, 2005

(54) MULTI-PIECE GOLF BALL AND METHOD FOR MANUFACTURING THE SAME

(75) Inventors: Seiichiro Endo, Kobe (JP); Keiji Ohama, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/714,659

(22) Filed: Nov. 18, 2003

(65) Prior Publication Data

US 2004/0110576 A1 Jun. 10, 2004

(30) Foreign Application Priority Data

Nov. 19, 2002 (JP) ..... 2002-334789

(51) Int. Cl.[7] ..... A63B 39/00
(52) U.S. Cl. ..... 473/355; 473/374
(58) Field of Search ..... 473/351, 371, 473/373, 374, 375, 376, 377

(56) References Cited

U.S. PATENT DOCUMENTS 6,010,412 A 1/2000 Moriyama
6,186,906 B1 * 2/2001 Sullivan et al. ..... 473/351
2003/0153405 A1 * 8/2003 Shannon et al. ..... 473/371

FOREIGN PATENT DOCUMENTS

| | | |
|---|---|---|
| EP | 0 600 721 A1 | 6/1994 |
| JP | 9-308709 A | 12/1997 |
| JP | 2001-46554 A | 2/2001 |
| JP | 2001-137387 A | 5/2001 |

* cited by examiner

*Primary Examiner*—Raeann Gorden
(74) *Attorney, Agent, or Firm*—Birch, Stewart, Kolasch & Birch, LLP

(57) ABSTRACT

A multi-piece golf ball with improved carry without sacrificing properties like spin performance, durability, coefficient of restitution, and the feel when the ball is hit, the golf ball including a core, an intermediate layer surrounding the core, and the cover surrounding the intermediate layer, where a plurality of voids are distributed in at least one of the core, the intermediate layer or the cover along the spherical surface of the core or intermediate layer, or the cover. 20-600 voids are formed on at least one of the interfaces between the core and the intermediate layer, between a plurality of intermediate layers, or between the intermediate layer and the cover.

13 Claims, 4 Drawing Sheets

FIG. 4A1
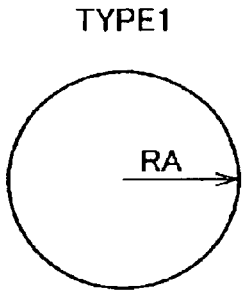
FIG. 4A2
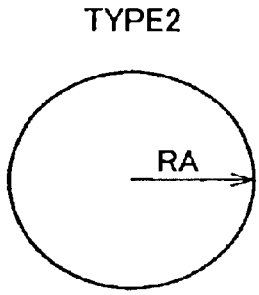
FIG. 4A3
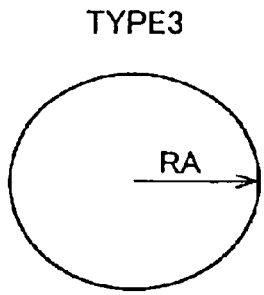
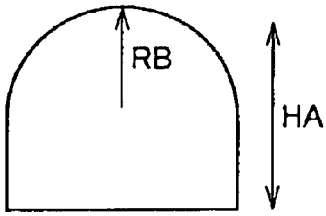
FIG. 4B1
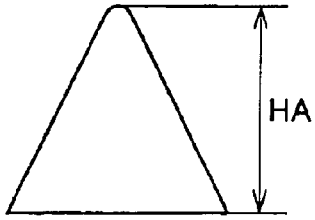
FIG. 4B2
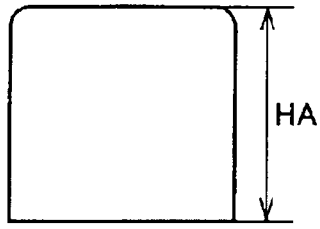
FIG. 4B3

MULTI-PIECE GOLF BALL AND METHOD FOR MANUFACTURING THE SAME

This Nonprovisional application claims priority under 35 U.S.C. §119(a) on Patent Application No(s). 2002-334789 filed in JAPAN on Nov. 19, 2002, the entire contents of which are hereby incorporated by reference.

BACKGROUND OF THE INVENTION

1. Field of the Invention

The present invention relates to a multi-piece golf ball with improved carry without sacrificing properties such as spin performance, durability, coefficient of restitution, the feel when the ball is hit, and the like.

2. Description of the Background Art

Basic properties required of a golf ball include carry, spin performance, durability, the feel when the ball is hit, and the like. In order to increase the carry, a golf ball preferably has a high moment of inertia.

For example, a multi-piece golf ball with an intermediate layer between the core and the cover has a larger specific gravity in the intermediate layer than the core so as to achieve a higher moment of inertia of the ball. When a golf ball with such a structure is hit by the golf club, it generates spins and thereby produces a lift that is normal to the trajectory of the ball. While the ball flies upward upon being shot, the lift in its horizontal component functions to exert a negative force to the ball with respect to the direction in which the ball travels, thereby decreasing the speed of the ball, which was high immediately after being shot. On the other hand, in the lift caused by the spin of the ball that has passed the highest point of the trajectory and is flying downwards, its horizontal component affects the ball as a positive force with respect to the direction in which the ball travels. Thus, it is preferable to have a greater lift when the ball is flying downwards in order to increase the carry.

Consequently, to increase the carry of a golf ball, it is preferable to have a low spin rate when the ball is flying upwards upon being shot and to prevent the spin rate from decreasing while the ball is flying downwards. Accordingly, it is preferred to design a golf ball to have a higher moment of inertia.

In order to increase the moment of inertial of a golf ball, it has been proposed to decrease the weight of the core. The core of such a conventional golf ball is composed of a molded rubber vulcanizate mixed with a light weight filler, a molded resin mixed with a light weight filler, or a molded foam of a rubber or resin (see European Patent Publication No. 0600721). Unfortunately, the use of this technique causes the intermediate layer to contain a large amount of filler, resulting in a lower coefficient of restitution of the golf ball which results, in turn, in a smaller carry.

Also, a foam may be used for the core of a golf ball to decrease the specific gravity of the core, while providing a cover or an intermediate layer with high specific gravity in order to increase the moment of inertia (see, for example, U.S. Pat. No. 6,010,412). Although this technique provides increased moment of inertia of a golf ball, it suffered from a lower coefficient of restitution and lower durability of the golf ball.

Further, the technique is known to provide a golf ball composed of a hollow core and a cover layer, where the hollow core is constructed of a hollow portion with a diameter of 5 to 30 mm and the remaining portion of the core forming the outer layer of the hollow core, the outer layer being composed of a molded vulcanizate of a rubber composition that contains a base rubber, a metallic salt of an unsaturated carboxylic acid, an organic peroxide and a filler, in order to provide increased moment of inertia, greater shot angle when the ball is hit and longer carry, and to improve the soft feel (Japanese Patent Laying-Open No. 9-308709). Such a golf ball, however, has the disadvantage of a lower coefficient of restitution of the golf ball and a poor durability.

SUMMARY OF THE INVENTION

The present invention provides a multi-piece golf ball with excellent aerodynamic characteristics and improved carry without sacrificing properties such as spin performance, durability, coefficient of restitution, and the feel.

The present invention provides a multi-piece golf ball including a core, an intermediate layer surrounding the core and a cover surrounding the intermediate layer, characterized in that a plurality of voids are distributed in at least one of said core, said intermediate layer or said cover along a spherical surface thereof.

Further, the present invention provides a multi-piece golf ball including a core, an intermediate layer surrounding the core and the cover surrounding the intermediate layer, characterized in that a plurality of voids are distributed in at least one of the intermediate layer and the cover along the spherical surface of the intermediate layer or the cover.

The multi-piece golf ball has formed therein 20 to 600 voids in contact with at least one of the interfaces between the core and the intermediate layer, between multiple intermediate layers, and between the intermediate layer and the cover. Preferably, the volume of each of the voids is 0.75 to 6 $mm^3$ and the number of the voids is 20 to 550.

Preferably, the total volume of the voids is 0.5–50% with respect to the volume of the layer in which the voids are formed, and the layer with the voids preferably has a thickness of 0.5–5 mm.

The present invention provides a method of manufacturing a multi-piece golf ball including the step of molding a half shell of an intermediate layer with gaps formed on its inner surface by using a mold with projections on its spherical surface, and the step of covering a core with a pair of half shells to form an assembly of the core and the intermediate layer. The step of covering a core with a pair of half shells to form an assembly of the core and the intermediate layer is preferably provided by press-molding at a temperature of 100 to 140° C. under a pressure of 0.1–20 $kg/cm^2$. Forming thus the voids provides a lower spin rate when the golf ball is hit, increases carry and improves the feel and control when the ball is hit at a lower speed.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 4A1 and 4B1, FIGS. 4A2 and 4B2, and FIGS. 4A3 and 4B3 show a plan view and a cross sectional view of Type 1, Type 2 and Type 3, respectively.

DESCRIPTION OF THE PREFERRED EMBODIMENTS

The present invention provides a multi-piece golf ball including a core, an intermediate layer surrounding the core and the cover surrounding the intermediate layer, characterized in that at least one of the core, the intermediate layer, and the cover has a plurality of voids distributed along the spherical surface of the core, the intermediate layer or the cover.

<Structure of Golf Ball>

Figure 1:
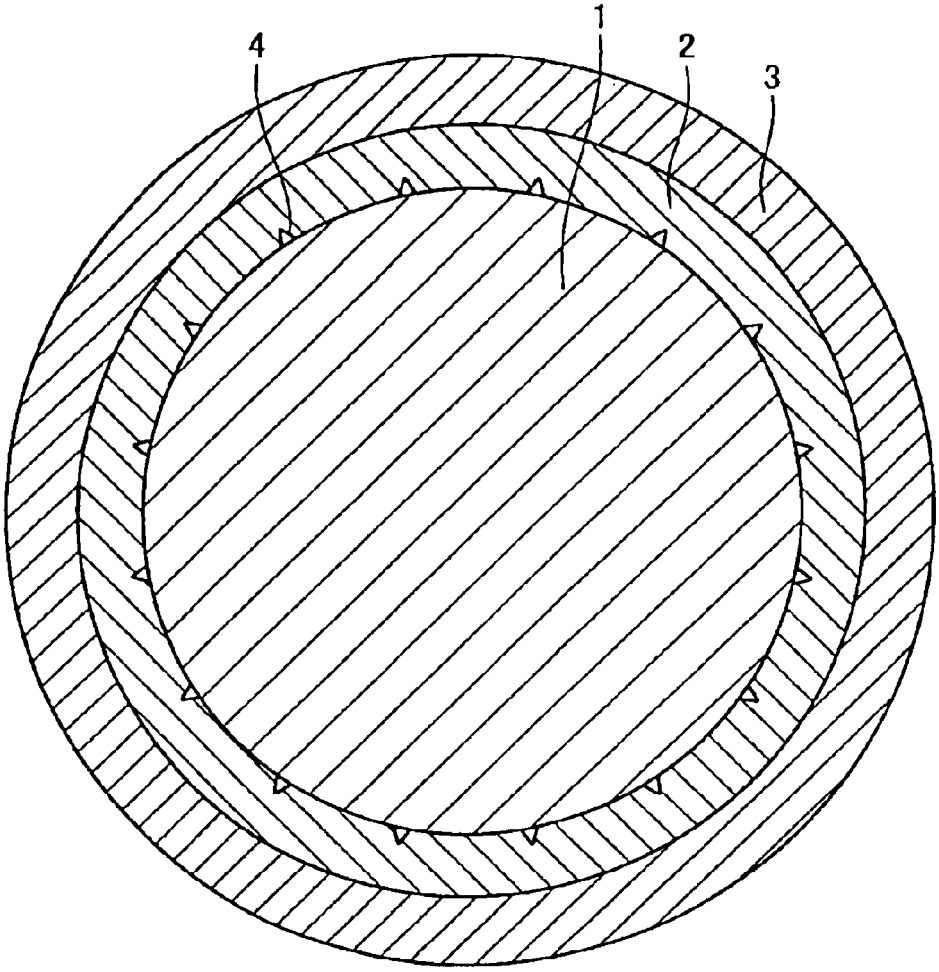
FIG. 1 shows a cross section of a golf ball according to the present invention.

An embodiment of the multi-piece golf ball according to the present invention will be described with reference to the cross sectional view shown in FIG. 1. In FIG. 1, a multi-piece golf ball is composed of a core 1, an intermediate layer 2 formed around core 1, and a cover 3 surrounding intermediate layer 2. A plurality of voids 4 are distributed along the interface between the outer spherical surface of the core and the inner spherical surface of the intermediate layer.

The number of the voids formed ranges from 20 to 600, preferably from 20 to 550 in one golf ball. With less than 20 voids, the spin rate is high, resulting in a shorter carry. On the other hand, more than 600 holes cause the coefficient of restitution of the golf ball to be decreased, adversely affecting the carry. Particularly, the number of the voids is preferably in the range from 50 to 400.

The volume of each void (Va) is preferably in the range from 0.75–6 $mm^3$. A volume of a void that is too large causes inferior durability, while a volume of a void that is too small provides difficulties in manufacturing.

The ratio (Va/Vl) of the total volume of the voids (Va) to the volume of the layer with voids (the core, the intermediate layer or the cover layer) (Vl) is in the range of 0.5–50%. When such a ratio (VA/Vl) is below 0.5%, the spin rate is high. With more than 50%, the coefficient of restitution of a golf ball tends to be small. Preferably, the ratio (Va/Vl) is in the range of 0.7–45%, more preferably 0.8–40%.

The layer with voids, typically the outer layer of the core of a composite core, the intermediate layer, or the inner layer of the cover of a composite cover, has a thickness in the range of 0.5–5 mm. A thickness smaller than 0.5 mm provides insufficient formation of voids, causing the spin rate to increase. On the other hand, a thickness greater than 5 mm causes difficulty in molding and unstable production of homogenous voids. Preferably, the thickness of the layer is in the range of 0.5–4.0 mm, and more preferably in the range of 0.8–4 mm.

The voids are formed along the inner surface or the outer surface of the core, the intermediate layer or the cover. They can be shaped as domes, cylinders, prisms, or cones. The voids are usually distributed along the interface of the core, the intermediate layer or the cover. They can be formed in one layer or in a plurality of layers. Preferably, the voids are formed either in the intermediate layer or the cover.

The layer with voids preferably has a Shore D hardness of 70 or less and a JIS-C hardness of 20 or more. A Shore D hardness that is larger than 70 does not provide an improvement of the feel due to the voids formed, while a JIS-C hardness below 20 provides a smaller coefficient of restitution, causing the carry of the golf ball to be shorter.

The voids must be formed homogeneously along the layer. Accordingly, the position of the voids are preferably designed symmetrically with respect to any axis of symmetry on the spherical surface of the golf ball, assuming that the spherical surface is divided into regular polyhedrons. The difference between the maximum and minimum values of the moment of inertia must be set to be not more than 3 $gcm^2$ in any direction of rotation, in order to prevent a deviated trajectory when the ball is hit.

Figure 5:
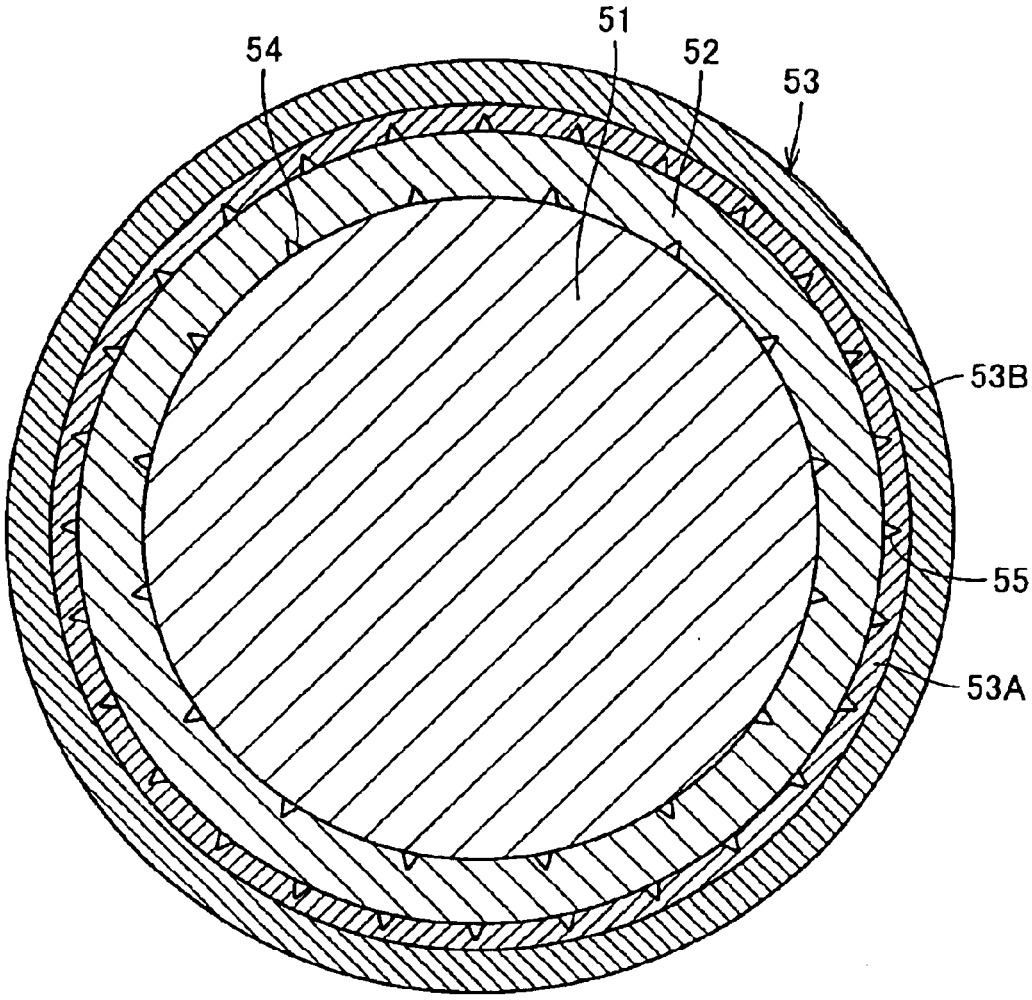
FIG. 5 shows a cross section of a golf ball according to the present invention.

FIG. 5 shows another embodiment of the present invention. A golf ball is shown to be composed of a core 51, an intermediate layer 52 surrounding it, and a cover 53. The cover is formed of a composite layer of an inner cover 53A and outer cover 53B. The inner surface of intermediate layer 52 has voids 54 and the inner surface of inner cover 53A has voids 55, each formed along a spherical surface. In the present embodiment, unlike the embodiment shown in FIG. 1, the voids are formed in two layers, i.e. the intermediate layer and the inner cover, thereby facilitating the adjustment in the overall balance of the feel, durability, spin performance and the like.

<Core>

The multi-piece golf ball of the present invention uses a thread wound core, a single layer core or a multilayer core, and can be employed in a thread wound ball or a solid ball. The core typically has a specific gravity in the range of 1.05–1.25, which can be adjusted as appropriate by the amount of the mixed filler.

Desirably, the core has a diameter of 10 mm–41.0 mm, preferably 15.0 mm–40.5 mm, particularly 30.0–39.0 mm. A diameter smaller than 10.0 mm requires the intermediate layer or the cover to be thicker than desired, resulting in a lesser coefficient of restitution or a hard and inferior feel. On the other hand, a diameter of the core greater than 41.0 mm requires the intermediate layer or the cover to be thinner than desired, whereby the function of the intermediate layer and the cover will not be exhibited sufficiently.

The compressive deformation of the core when a load from 10 kg to 130 kg is applied is preferably in the range of 2.0 mm–7.0 mm, particularly 2.5 mm–5.00 mm. A deformation below 2.0 mm tends to give an inferior feel, while a deformation greater than 7.0 mm is disadvantageous in terms of resilience.

The core of the golf ball is constructed from a cross-linked rubber composition. A suitable base for its rubber component is cis-1,4-butadiene rubber. It should be noted that other types of rubber may be used such as a natural rubber, styrene-butadiene rubber, isoprene rubber, chloroprene rubber, butyl rubber, ethylene-propylene rubber, ethylene-propylene-diene rubber, acrylonitrile rubber, which may be blended in at mass 40% in the rubber component.

A cross-linker for the rubber composition may be used such as a metallic salt of an α, β-ethylenic unsaturated carboxylic acid that is produced by reacting an α, β-ethylenic unsaturated carboxylic acid such as acrylic acid or methacrylic acid with a metal oxide while preparing the rubber composition, or a metallic salt of an α, β-ethylenic unsaturated carboxylic acid such as zinc acrylate, zinc methacrylate; further, a polyfunctional monomer, N,N'-phenylbismaleimide, or sulfur may also be used. Particularly, a metallic salt of an α, β-ethylenic unsaturated carboxylic acid may preferably be used.

For example, when a metallic salt of an α, β-ethylenic unsaturated carboxylic acid is used, the preferred amount is 20–40 parts by mass per 100 parts of the rubber component. When an α, β-ethylenic unsaturated carboxylic acid and a metal oxide are reacted while preparing the rubber composition, the preferred amount is 15–30 parts by mass of an α, β-ethylenic unsaturated carboxylic acid and 15–35 parts by mass of a metal oxide such as zinc oxide per 100 parts of the α, β-ethylenic unsaturated carboxylic acid.

For a filler used in the rubber composition, one or more types of inorganic powder can be used, such as barium sulfate, calcium carbonate, clay, zinc oxide and the like. The amount of such a filler is preferably in the range of 5–50 parts by mass per 100 parts of the rubber component. A softener or liquid rubber can be mixed as appropriate in order to improve the workability or to adjust the hardness. An anti-oxidant may also be mixed appropriately.

For a cross-linking initiator, an organic peroxide may be used such as dicumyl peroxide, 1,1-bis (t-butyl peroxy)3,3,5-trimethylcyclohexane, and the like. The amount of such a cross-linking initiator is preferably in the range of 0.1–5, particularly 0.3–3 parts by mass per 100 parts of the rubber component.

According to the present invention, the core may be provided as a single layer or a composite layer having a plurality of layers that are different in properties such as the specific gravity, hardness or the like. In this case, the ingredients of the core are not limited to the above description.

In manufacturing a core, the above ingredients are mixed using a roll, kneader, a Banbury mixer, then cured using a mold under pressure at 145° C.–200° C., preferably 150° C.–175° C. for 10–40 minutes to provide a core. The resultant core may have an adhesive applied to its surface or have its surface roughened in order to improve the contact with the cover.

<Intermediate Layer>

The intermediate layer is a layer that can include voids and may be formed as a single layer or a plurality of layers. The intermediate layer has a total thickness in the range of 0.5–7.0 mm, preferably 1.0–6.0 mm.

The intermediate layer may use, substantially similar to the core, a rubber composition with a diene rubber co-crosslinked with e.g. a metallic salt of an α, β-ethylenic unsaturated carboxylic acid, or an olefin resin, polyester resin, polyurethane resin, polyamide resin and the like.

<Olefin Resin>

The olefin resin used for the cover composition of the present invention should be construed most broadly, and may be a polymer containing an olefin as a polymer unit. It includes, for example, an olefin thermoplastic resin, ionomer resin, olefin thermoplastic elastomer and modified polymers thereof.

Olefin thermoplastic resins that can be used include polyethylene, polypropylene, polystyrene, ABS resin, acrylic resin, or methacrylic resin.

The ionomer resin includes, for example, a binary copolymer of an α-olefin and an α, β-unsaturated carboxylic acid having 3–8 carbon atoms that may be obtained by neutralizing at least part of its carboxylic group with a metal ion. Further, it includes a tertiary copolymer of an α-olefin, an α, β-unsaturated carboxylic acid with 3 to 8 carbon atoms and an α, β-unsaturated carboxylic ester with 2 to 22 carbon atoms that can be obtained by neutralizing at least part of its carboxylic group with a metal ion.

A preferred composition thereof, when the base polymer of the ionomer resin is a binary copolymer of an α-olefin and an α, β-unsaturated carboxylic acid with 3 to 8 carbon atoms, lies at 80–90 mass % of the α-olefin and 10–20 mass % of the α, β-unsaturated carboxylic acid. When the base polymer is a tertiary copolymer of an α-olefin, an α, β-unsaturated carboxylic acid with 3 to 8 carbon atoms and an α, β-unsaturated carboxylic ester with 2 to 22 carbon atoms, it is preferable to have 70–85 mass % of the α-olefin, 5–30 mass % of the α, β-unsaturated carboxylic acid, and 25 mass % or less of the α, β-unsaturated carboxylic ester. Such ionomer resins preferably have a melt index (MI) of 0.1–20, particularly 0.5–15. The above range of carboxylic acid or carboxylic ester content provides improved resilience.

The α-olefin includes, for example, ethylene, propylene, 1-butene and 1-pentene, where ethylene is particularly preferred. The α, β-unsaturated carboxylic acid with 3 to 8 carbon atoms includes, for example, acrylic acid, methacrylic acid, fumaric acid, maleic acid, crotonic acid and the like, where acrylic acid and methacrylic acid are particularly preferred. The unsaturated carboxylic ester includes methyl, ethyl, propyl, n-butyl, isobutyl ester and the like of acrylate, methacrylate, fumarate, maleate or the like, where acrylic ester and methacrylic ester are particularly preferred.

The metal ion used for neutralizing at least part of the carboxylic group in the copolymer of the α-olefin and α, β-unsaturated carboxylic acid or in the tertiary copolymer of the α-olefin, α, β-unsaturated carboxylic acid and α, β-unsaturated carboxylic ester includes sodium ion, lithium ion, zinc ion, magnesium ion, potassium ion and the like.

When the ionomer resin has at least part of the carboxylic group in the copolymer of ethylene and acrylic or methacrylic acid neutralized by a metal ion, it preferably has a melt index of 3–7 and a flexural modulus of 200–400 MPa, which can also be called the high rigid and high flow type.

Examples of the ionomer resins in their trade names, include ionomer resins of binary copolymer available from Mitsui-Dupont Chemical Co., Ltd. such as Hi-milan 1555 (Na), Hi-milan 1557 (Zn), Hi-milan 1605 (Na), Hi-milan 1706 (Zn), Hi-milan 1707 (Na), Hi-milan AM7318 (Na), Hi-milan AM7315 (Zn), Hi-milan AM7317 (Zn), Hi-milan AM7311 (Mg) and Hi-milan MK7320 (K); and ionomer resins of tertiary copolymer such as Hi-milan 1856 (Na), Hi-milan 1855 (Zn) and Hi-milan AM7316 (Zn).

Further, Dupont commercially provides ionomer resins such as Surlyn 8945 (Na), Surlyn 8940 (Na), Surlyn 9910 (Zn), Surlyn 9945 (Zn), Surlyn 7930 (Li), and Surlyn 7940 (Li); and ionomer resins of tertiary copolymer such as Surlyn AD 8265 (Na) and Surlyn AD 8269 (Na).

Exxon Corp. provides ionomer resins such as Iotec 7010 (Zn), Iotec 8000 (Na), and the like. NA, Zn, K, Li, Mg provided in the parentheses after the trade names above indicate the types of their neutralized metal ions. Further, in the present invention, the ionomer resins used for the cover composition may be provided by mixing two or more of the above examples, or mixing two or more of ionomer resins neutralized by the above monovalent metal ion and ionomer resins neutralized by the bivalent metal ion.

An olefin thermoplastic elastomer is understood to contain an olefin unit in the polymer chain, an concept that includes the so-called styrene thermoplastic elastomer, and contains a block copolymer having a soft segment and a hard segment within the molecule. A soft segment is a unit such as a butadiene block or isoprene block obtained from a conjugated diene compound. For the conjugated diene compound, one or more of e.g. butadiene, isoprene, 1,3-pentadiene, 2,3-dimethyl-1,3-butadiene may be selected, butadiene and isoprene and combinations thereof being particularly preferred. The component forming the hard segment includes ethylene, propylene, styrene and derivatives thereof, such as polyethylene blocks, polypropylene blocks or styrene blocks from one or more compounds selected from α-methyl styrene, vinyltoluene, p-tert butyl styrene and the like.

The styrene thermoplastic elastomer includes, for example, styrene-isoprene-butadiene-styrene block copolymer (SIBS structure), styrene-butadiene-styrene block copolymer (SBS structure), styrene-ethylene-butylene-styrene block copolymer with the double bond portion of the butadiene hydrogenated in the SBS structure (SEBS structure), styrene-isoprene-styrene block copolymer (SIS structure), styrene-ethylene-propylene-styrene block copolymer with the double bond portion of the isoprene hydrogenated in the SIS structure (SEPS structure), styrene-ethylene-ethylene-propylene-styrene copolymer (SEEPS structure) and modified polymers thereof. One exemplary product for the SEBS structure is Rabalon SR04 from Mitsubishi Chemical Corp.

The content of styrene (or its derivatives) in the SIBS, SBS, SEBS, SIS, SEPS, or SEEPS structure is preferably in the range of 10–50% by mass in the copolymer, particularly 15–45% by mass.

The present invention may use a modified polymer provided by modifying part of the copolymer of SIBS, SBS, SEBS, SIS, SEPS, or SEEPS structure by a functional group selected from epoxy group, hydroxyl group, acid anhydride, and carboxyl group.

<Polyester Resin>

The polyester resin includes polyester thermoplastic resins and polyester thermoplastic elastomers. A polyester thermoplastic elastomer is composed of a hard segment of polyester structure and a soft segment of polyether or polyester. The examples, again in trade names, include Hytrel from Dupont-Toray Co. Ltd., Pelprene P. S. from Toyobo Co. Ltd., Grilax E from Dainippon Ink and Chemicals Inc., and Primalloy from Mitsubishi Chemical Co., Ltd.

<Polyurethane Resin>

The polyurethane resin includes thermoplastic polyurethane resins and polyurethane thermoplastic elastomers. A polyurethane thermoplastic elastomer is composed of a hard segment of urethane structure and a soft segment of polyester or polyether. Examples in trade names include Miractran from Nippon Miractran Co., Ltd., Pandex from Dainippon Ink and Chemicals Inc., Paraprene from Nippon Polyurethane Industry Co., Ltd., Pellethane from Dow Chemical Japan Ltd., Ellastollan from BASF Japan Ltd.

<Polyamide Resin>

The polyamide resin includes polyamide thermoplastic resins and polyamide thermosplastic elastomers. A polyamide thermoplastic elastomer is composed of a hard segment of polyamide and a soft segment of polyether or polyester. Examples in trade names include Pebax from Toray Co., Ltd., Diamide PAE from Daicel-Huls, Grilax A from Dainippon Ink and Chemicals Inc., Novamid PAE from Mitsubishi Engineering-Plastics Co., Ltd., UBE PAE from Ube Industries Ltd., Grilon ELX, Grilamid ELY from Ems Japan, S-TPAE from Sekisui Chemical Co., Ltd.

<Other Ingredients>

In addition to the olefin resins as main components, the composition of the intermediate layer may be mixed with a filler such as barium sulfate or a colorant such as titanium dioxide, a dispersant, an anti-oxidant in a range of amount that does not deteriorate the desired characteristics of the golf ball cover.

<Cover>

Substantially the same materials may be used for the cover as for the intermediate layer, and its ingredients can be adapted to the required characteristics of the cover. The cover may have voids formed therein and may be composed of a single layer or a plurality of layers. The cover has a total thickness in the range of 0.4–5.0 mm, preferably 0.8–2.5 mm. A thickness less than 0.4 mm provides poor durability and abrasion resistance, and a thickness greater than 5.0 mm causes a hard feel when the ball is hit. The cover has a Shore D hardness of 40–70, preferably 44-66. A Shore D hardness less than 40 provides excess softness and poor cut resistance, while a Shore D hardness greater than 70 provides a hard feel and a inferior durability. Here, the Shore D hardness is measured in accordance with ASTM-D2240. The golf ball typically has a diameter in the range of 42.67–43.00 mm and a weight in the range of 45.00–45.93 g.

<Method for Manufacturing Golf Ball>

Figure 2:
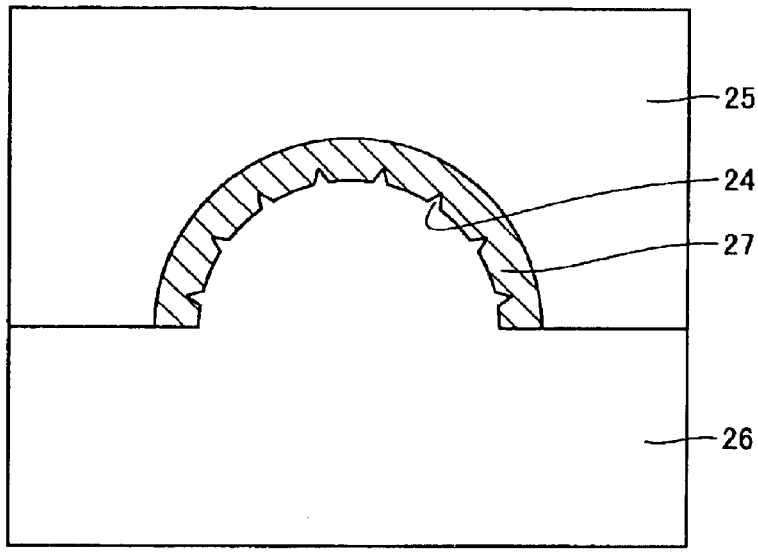
FIG. 2 shows a schematic cross section of a mold used for molding a half shell of an intermediate layer.
Figure 3:
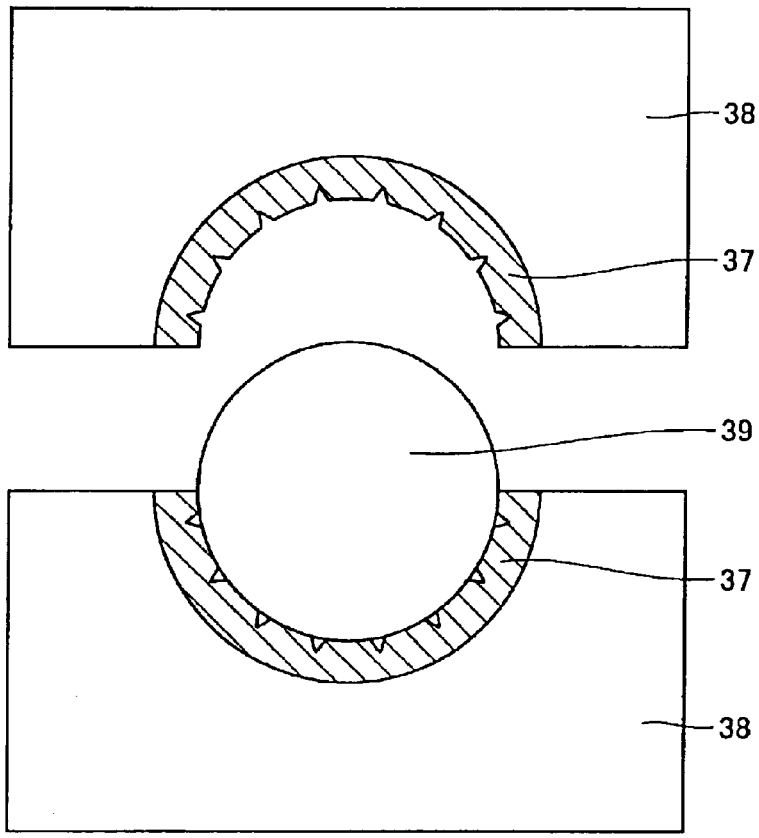
FIG. 3 shows a schematic cross section of a mold for integrally covering the core with half shells of the intermediate layer.

A method for manufacturing the multi-piece golf ball according to the invention will be described with reference to the drawings. FIG. 2 is a schematic cross section illustrating a mold for molding the intermediate layer half shell in use for the golf ball. FIG. 3 is a schematic cross section illustrating a mold for covering a core with intermediate layer half shells. First, a rubber or resin composition for the intermediate layer is molded by using an extruder into a cylindrical intermediate layer. Next, a hemispherical upper mold 25 having a hemispherical cavity shown in FIG. 2 and a lower mold 26 having a hemispherical core corresponding to the golf ball core are used for heat pressing the rubber or resin composition for the intermediate layer at 120–160° C. for 2–15 minutes, for example, thereby molding a hemispherical intermediate layer 27.

The core of lower mold 26 has projections 24 formed homogeneously along its hemispherical surface. The shape of projections 24 will now be explained with reference to FIGS. 4A1, 4B1, 4A2, 4B2, 4A3, and 4B3. In the drawings, TYPE 1 exhibits a dome with an arched top, which is shown in a plan view in FIG. 4A1; its cross section is shown in FIG. 4B1. TYPE 2 exhibits a cone which is shown in a plan view in FIG. 4A2 and in a cross section in FIG. 4B2. TYPE 3 is a cylinder, shown in a plan view in FIG. 4A3 and in a cross section in FIG. 4B3. In the drawings, RA indicates the radius of the bottom of each projection, HA the height thereof, and RB the radius of the dome. A prism or a pyramid may also be employed for the projection, and its shape is not specifically limited. The recess in the intermediate layer formed by each projection 24 provides a void corresponding substantially to the shape of the projection when it is integrated with the core.

Subsequently, two molds for the core 38, an upper and a lower ones shown in FIG. 3, are used to sandwich a premolded cured or semi-cured core 39 with a pair of half shell 37 of the intermediate layer to perform integral molding at 140–180° C. for 10–60 minutes, for example, thereby forming an assembly of core 39 and intermediate layer 37 formed thereon, forming voids on the interface therebetween.

Although the intermediate layer was used to illustrate the method for forming voids, a similar method may be employed when voids are formed in the outer layer of the core or the cover.

Different methods are used when a rubber composition is used or a resin composition is used for the layer with voids. First, the case in which a rubber composition is used for the layer with voids, e.g. the intermediate layer, will be explained. The core is premolded: When a rubber composition is used for the core, cured molding (or semi-cured molding) is performed; when a resin composition is used, molding is performed. Next, semi-cured molding (or cured molding) is performed to the uncured rubber composition in a mold to mold a half shell of, for example, an intermediate layer including voids. The spherical core surface of the mold has projections formed thereon for forming voids. The core is then covered by a pair of half shells of the intermediate layer and integrally molded by curing press. The pressure is in the range of 0.1–20 kg/cm$^2$ so as to prevent the voids from being squashed, although adjustment may be made depending on the type of the composition.

Next, the case will be explained in which a resin composition is used for the layer with voids. The core is preformed: when a rubber composition is used for the core, cured molding (or semi-cured molding) is performed, while molding is performed when a resin composition is used for the core. Next, the resin composition is injection-molded or press-molded to shape a half shell of, for example, an intermediate layer including voids, where the spherical core surface of the mold has projections formed thereon for forming voids. The core is then covered by a pair of half shells of intermediate layer, pressed and integrally molded. Press-molding is performed under a pressure of 0.1–20 kg/cm$^2$ at a temperature of 100-140° C. so as to prevent resin from melting and the voids from being squashed, although adjustment may be made depending on the type of the composition.

Molding of Cover

According to the present invention, the cover may be molded onto the core by using known methods. The cover composition may be prefabricated as half shells, and two of them are used to surround the core, and then compression molded at 120–170° C. for 1–10 minutes, or the cover composition may be directly injection-molded onto the core to surround it. Further, when the cover is molded, multiple dimples are formed on the surface as appropriate. For the purpose of improved aesthetic appearance and commercial value, the golf ball is usually paint-finished and provided with a marking stamp before being put into the market.

EXAMPLES

Examples 1–10, Comparative Examples 1–7

(1) Production of Core

A rubber composition for the core having a butadiene rubber as its main component was formulated as in Table 1, and then heat molded within a mold, thereby producing spherical cores with diameters as in Table 1. Table 1 shows the core composition and the properties of the produced cores.

TABLE 1

| Specification of Core | | | | | | | | | | |
|---|---|---|---|---|---|---|---|---|---|---|
| | Examples | | | | | | | | | |
| | 1 | 2 | 3 | 4 | 5 | 6 | 7 | 8 | 9 | 10 |
| Ingredients | | | | | | | | | | |
| BR-01 | 100 | 100 | 100 | 100 | 100 | 100 | 100 | 100 | 100 | 100 |
| Zinc acrylate | 28.0 | 23.0 | 24.5 | 23.0 | 26.0 | 23.0 | 23.0 | 23.0 | 28.0 | 24.5 |
| Zinc oxide | As appro-priate | As appro-priate | As appro-priate | As appro-priate | As appro-priate | As appro-priate | As appro-priate | As appro-priate | As appro-priate | As appro-priate |

TABLE 1-continued

| Specification of Core | | | | | | | | | | |
|---|---|---|---|---|---|---|---|---|---|---|
| Dicumyl peroxide | 0.6 | 0.6 | 0.6 | 0.6 | 0.6 | 0.6 | 0.6 | 0.6 | 0.6 | 0.6 |
| Diphenyl sulfide | 0.5 | 0.5 | 0.5 | 0.5 | 0.5 | 0.5 | 0.5 | 0.5 | 0.5 | 0.5 |
| Outer diameter (mm) | 36.7 | 35.5 | 37.9 | 35.5 | 36.7 | 35.5 | 35.5 | 35.5 | 36.7 | 37.9 |
| Curing conditions | | | | | | | | | | |
| Temperature (° C.) | 155 | 155 | 155 | 155 | 155 | 155 | 155 | 155 | 155 | 155 |
| Duration (min) | 20 | 25 | 25 | 23 | 23 | 25 | 25 | 25 | 20 | 25 |

| | Comparative Examples | | | | | | |
|---|---|---|---|---|---|---|---|
| | 1 | 2 | 3 | 4 | 5 | 6 | 7 |
| Ingredients | | | | | | | |
| BR-01 | 100 | 100 | 100 | 100 | 100 | 100 | 100 |
| Zinc acrylate | 28.0 | 23.0 | 24.5 | 23.0 | 26.0 | 28.0 | 28.0 |
| Zinc oxide | As appro-priate | As appro-priate | As appro-priate | As appro-priate | As appro-priate | As appro-priate | As appro-priate |
| Dicumyl peroxide | 0.6 | 0.60 | 0.60 | 0.60 | 0.60 | 0.6 | 0.6 |
| Diphenyl sulfide | 0.5 | 0.50 | 0.50 | 0.50 | 0.50 | 0.5 | 0.5 |
| Outer diameter (mm) | 37.9 | 35.5 | 37.9 | 35.5 | 36.7 | 36.7 | 36.7 |
| Curing conditions | | | | | | | |
| Temperature (° C.) | 155 | 155 | 155 | 155 | 155 | 155 | 1.55 |
| Duration (min) | 20 | 25 | 25 | 23 | 23 | 20 | 20 |

(Note 1)
BR01: polybutadiene from Japan Synthetic Rubber Co., Ltd. with 96% of cis-1, 4 bond;
(Note 2)
"As appropriate" for zinc oxide means that the amount was adjusted such that the weight of the ball was 45.4 g.

(2) Production of Intermediate Layer

A rubber or resin composition for the intermediate layer having a butadiene rubber as its main component was formulated as in Table 2 and molded in a mold to provide a half shell. For the shape of the projections for forming voids, each of the shapes of FIG. 4 was used. The molding conditions for the half shells and the curing conditions for covering the core are shown in Table 2. The core was covered with the half shells at a pressure of 1 kg/cm$^2$. The specification of the resultant composite layer of core/intermediate layer is shown in Table 2.

TABLE 2

| Specification of Intermediate Layer | | | | | | | | | | |
|---|---|---|---|---|---|---|---|---|---|---|
| | Examples | | | | | | | | | |
| | 1 | 2 | 3 | 4 | 5 | 6 | 7 | 8 | 9 | 10 |
| Ingredients | | | | | | | | | | |
| BR 01 | 100 | 100 | 100 | 100 | | 100 | 100 | 100 | 100 | 100 |
| Magnesium Methacrylate | 45 | 45 | 25 | | | 45 | 45 | 45 | 45 | 25 |
| Magnesium oxide | 35.6 | 35.6 | 34.6 | | | 35.6 | 35.6 | 35.6 | 35.6 | 34.6 |
| Dicumyl peroxide | 5 | 5 | 4 | 0.7 | | 5 | 5 | 5 | 5 | 4 |
| Zinc acrylate | | | | 35 | | | | | | |
| Zinc oxide | | | | 15.8 | | | | | | |
| Suryln 8945 | | | | | 28 | | | | | |
| Suryln 9945 | | | | | 28 | | | | | |
| Rabalon SR04 | | | | | 44 | | | | | |
| Type of void | E | A | F | G | H | B | C | D | none | K |
| Total volume of voids Va (mm$^3$) | 179 | 685 | 84 | 685 | 265 | 110 | 79 | 143 | | 1307 |
| Va/Vl (%) | 2.8 | 7.7 | 2.2 | 7.7 | 4.2 | 1.2 | 0.9 | 1.6 | | 34.7 |
| Half-shell molding conditions | | | | | | | | | | |
| Temperature (° C.) | 135 | 140 | 140 | 140 | 140 | 140 | 140 | 140 | | 140 |
| Duration (minutes) | 5 | 5 | 5 | 5 | 5 | 5 | 5 | 5 | | 5 |

TABLE 2-continued

| Specification of Intermediate Layer | | | | | | | | | | |
|---|---|---|---|---|---|---|---|---|---|---|
| Curing conditions | | | | | | | | | | |
| Temperature (° C.) | 160 | 160 | 155 | 165 | 150 | 160 | 160 | 160 | 160 | 155 |
| Duration (minutes) | 20 | 20 | 20 | 15 | 5 | 20 | 20 | 20 | 20 | 20 |
| Thickness of intermediate Layer (mm) | 1.4 | 2 | 0.8 | 2 | 1.4 | 2 | 2 | 2 | 1.4 | 0.8 |
| Volume of intermediate layer Vl($mm^3$) | 6387 | 8844 | 3765 | 8844 | 6387 | 8844 | 8844 | 8844 | 6387 | 3765 |

| | Comparative Examples | | | | | | |
|---|---|---|---|---|---|---|---|
| | 1 | 2 | 3 | 4 | 5 | 6 | 7 |
| Ingredients | | | | | | | |
| BR 01 | 100 | 100 | 100 | 100 | | 100 | 100 |
| Magnesium Methacrylate | 45 | 45 | 25 | | | 45 | 45 |
| Magnesium oxide | 35.6 | 35.6 | 34.6 | | | 35.6 | 35.6 |
| Dicumyl peroxide | 5 | 5 | 4 | 0.7 | | 5 | 5 |
| Zinc acrylate | | | | 35 | | | |
| Zinc oxide | | | | 15.8 | | | |
| Suryln 8945 | | | | | 28 | | |
| Suryln 9945 | | | | | 28 | | |
| Rabalon SR04 | | | | | 44 | | |
| Type of void | none | none | none | none | none | I | J |
| Total volume of voids Va ($mm^3$) | | | | | | 15 | 412 |
| Va/Vl (%) | | | | | | 0.2 | 6.5 |
| Half-shell molding conditions | | | | | | | |
| Temperature (° C.) | 135 | 140 | 140 | 140 | 140 | 135 | 135 |
| Duration (minutes) | 5 | 5 | 5 | 5 | 5 | 5 | 5 |
| Curing conditions | | | | | | | |
| Temperature (° C.) | 160 | 160 | 155 | 165 | 150 | 160 | 160 |
| Duration (minutes) | 20 | 20 | 20 | 15 | 5 | 20 | 20 |
| Thickness of intermediate Layer (mm) | 1.4 | 2 | 0.8 | 2 | 1.4 | 1.4 | 1.4 |
| Volume of intermediate layer Vl($mm^3$) | 6387 | 8844 | 3765 | 8844 | 6387 | 6387 | 6387 |

(Note)
BR01: polybutadiene from Japan Synthetic Rubber Co., Ltd. with 96% of cis-1, 4 bond;
(Note 2)
Surlyn 8945: ionomer resin from Dupont;
(Note 3)
Surlyn 9945: ionomer resin from Dupont; and
(Note 4)
Rabalon SR04: polymer alloy of SEBS from Mitsubishi Chemical Corporation.
(Note 5)
Types of void are formed by the protrusions shown in Table 5.

(3) Preparation of Cover Composition

A cover composition as in Table 3 was mixed using a biaxial mixing extruder and was extruded at a cylinder temperature of 180° C. by the biaxial mixing extruder. The extruding conditions were as follows:

Screw diameter: 45 mm;

Screw revolution: 200 rpm; and

Screw L/D: 35.

The mixture was heated to 195–205° C. at the die of the extruder.

The above cover composition was injection-molded to provide spherical half shells, and two of them were used to surround the core. Press heat compression molding was performed in a mold at 150° C., and the golf ball was removed after cooling off. The surface was then painted, resulting in a golf ball with a diameter of 42.8 mm and a weight of 45.4 g. The specification of the resultant golf ball is shown in Table 4.

In Example 9, voids were formed in the cover layer, where the type of the voids was E of Table 5, Va was 179 $mm^3$, the volume of the cover layer Vl was 7760 $mm^3$. Consequently, (Va)/(Vl) was 2.3%. The hemispheric shells were molded at 130° C. for 8 minutes and, for covering the intermediate layer, press heat compression molding was performed at 142° C. for 6 minutes.

TABLE 3

| Specification of Cover | | | | | | | | | | |
|---|---|---|---|---|---|---|---|---|---|---|
| | Examples | | | | | | | | | |
| | 1 | 2 | 3 | 4 | 5 | 6 | 7 | 8 | 9 | 10 |
| Ingredients | | | | | | | | | | |
| Surlyn 8945 | 44 | 44 | 44 | 44 | 44 | 44 | 44 | 44 | 44 | 44 |
| Surlyn 9945 | 47 | 47 | 47 | 47 | 47 | 47 | 47 | 47 | 47 | 47 |
| Rabalon SR04 | 9 | 9 | 9 | 9 | 9 | 9 | 9 | 9 | 9 | 9 |
| Titanium dioxide | 2 | 2 | 2 | 2 | 2 | 2 | 2 | 2 | 2 | 2 |
| Void | None | None | None | None | None | None | None | None | E | None |
| Cover thickness (mm) | 1.6 | 1.6 | 1.6 | 1.6 | 1.6 | 1.6 | 1.6 | 1.6 | 1.6 | 1.6 |
| Shore D hardness | 59 | 59 | 59 | 59 | 59 | 59 | 59 | 59 | 59 | 59 |

| | Comparative Examples | | | | | | |
|---|---|---|---|---|---|---|---|
| | 1 | 2 | 3 | 4 | 5 | 6 | 7 |
| Ingredients | | | | | | | |
| Surlyn 8945 | 44 | 44 | 44 | 44 | 44 | 44 | 44 |
| Surlyn 9945 | 47 | 47 | 47 | 47 | 47 | 47 | 47 |
| Rabalon SR04 | 9 | 9 | 9 | 9 | 9 | 9 | 9 |
| Titanium dioxide | 2 | 2 | 2 | 2 | 2 | 2 | 2 |
| Void | None | None | None | None | None | None | None |
| Cover thickness (mm) | 1.6 | 1.6 | 1.6 | 1.6 | 1.6 | 1.6 | 1.6 |
| Shore D hardness | 59 | 59 | 59 | 59 | 59 | 59 | 59 |

(Note 1)
Surlyn 8945: ionomer resin from Dupont;
(Note 2)
Surlyn 9945: ionomer resin from Dupont; and
(Note 3)
Rabalon SR04: polymer alloy of SEBS from Mitsubishi Chemical Corporation.

TABLE 4

| Golf Ball Performance | | | | | | | | | | |
|---|---|---|---|---|---|---|---|---|---|---|
| | Examples | | | | | | | | | |
| | 1 | 2 | 3 | 4 | 5 | 6 | 7 | 8 | 9 | 10 |
| Flight performance (W#1, 40 m/s) | | | | | | | | | | |
| Shot angle (degree) | 12.1 | 12.2 | 12.4 | 12.3 | 12.4 | 12.2 | 12.1 | 12.1 | 12.1 | 12.5 |
| Spin rate (r.p.m) | 2450 | 2350 | 2200 | 2300 | 2250 | 2400 | 2450 | 2400 | 2500 | 2150 |
| Total carry (m) | 209.0 | 210.0 | 210.5 | 210.0 | 211.0 | 209.5 | 210 | 210 | 208.5 | 211.0 |
| Durability | 110 | 108 | 112 | 109 | 108 | 109 | 108 | 110 | 108 | 108 |
| Feel of impact when struck | ⊙ | ⊙ | ⊙ | ⊙ | ⊙ | ⊙ | ⊙ | ⊙ | ⊙ | ⊙ |

| | Comparative Examples | | | | | | |
|---|---|---|---|---|---|---|---|
| | 1 | 2 | 3 | 4 | 5 | 6 | 7 |
| Flight performance (W#1, 40 m/s) | | | | | | | |
| Shot angle (degree) | 11.8 | 11.9 | 11.8 | 11.8 | 11.9 | 11.9 | 11.9 |
| Spin rate (r.p.m) | 2600 | 2550 | 2650 | 2550 | 2650 | 2500 | 2600 |
| Total carry (m) | 206.0 | 206.5 | 206.0 | 207.0 | 206.5 | 205.0 | 207.0 |
| Durability | 100 | 100 | 100 | 100 | 100 | 95 | 100 |
| Feel of impact | X | X | X | X | X | X | X |

TABLE 4-continued

| Golf Ball Performance |
|---|
| when struck |

Number of dimples : 390
Total volume of dimples : 320 $mm^3$ (the sum of volumes of the regions each surrounded by the plane containing the dimple edge, and the dimple surface)
Dimple occupancy rate : 80% (percentage of the sum of areas of the planes each surrounded by the dimple edge with respect to the surface area of the virtual sphere of the ball)
Golf ball weight : 45.4 g
Golf ball outer diameter : 42.7 mm

TABLE 5

Specification of Protrusions of Core (Male Surface of Hemispherical Mold)

| Specification | Shape and Number of Protrusions | | | | | | | | | | Total volume |
|---|---|---|---|---|---|---|---|---|---|---|---|
| | 1-a | 2-a | 2-b | 2-d | 3-a | 3-b | 3-c | 3-d | 3-e | 3-f | Va ($mm^3$) |
| A | | | | | | 160 | 128 | 48 | | | 685 |
| B | | 160 | 176 | | | | | | | | 110 |
| C | 60 | 60 | | | | | | | | | 79 |
| D | | | 60 | | 480 | | | | | | 143 |
| E | | | | | 160 | 176 | | | | | 179 |
| F | | | | | 336 | | | | | | 84 |
| G | | | | | | 160 | 128 | 48 | | | 685 |
| H | | | | | | 336 | | | | | 265 |
| I | | | | 610 | | | | | | | 15 |
| J | | | | | | | | | 18 | | 412 |
| K | | | | | | | | | | 594 | 1307 |

TABLE 6

Dimension of Protrusions

| Shape of Protrusions | | Dimension (mm) RA | HA | RB | Volume Vi ($mm^3$) |
|---|---|---|---|---|---|
| TYPE 1 | 1-a | 0.5 | 1.5 | 0.5 | 1.05 |
| TYPE 2 | 2-a | 0.5 | 1 | — | 0.26 |
| TYPE 2 | 2-b | 0.5 | 1.5 | — | 0.39 |
| TYPE 2 | 2-c | 0.7 | 1.8 | — | 0.92 |
| TYPE 2 | 2-d | 0.2 | 0.6 | — | 6.025 |
| TYPE 3 | 3-a | 0.4 | 0.5 | — | 0.5 |
| TYPE 3 | 3-b | 0.5 | 1 | — | 0.79 |
| TYPE 3 | 3-c | 0.8 | 1.5 | — | 3.01 |
| TYPE 3 | 3-d | 0.8 | 1.8 | — | 3.6 |
| TYPE 3 | 3-e | 2.7 | 1 | — | 22.9 |
| TYPE 3 | 3-f | 1.0 | 0.7 | — | 2.2 |

<Method of Performance Evaluation>

(1) Shore D Hardness

Measurement was conducted in accordance with ASTM-D2240. A heat press-molded sheet with a thickness of about 2 mm made from the relevant materials was preserved at 23° C. for two weeks and then measured using a spring-type hardness meter of Shore D type.

(2) Durability

A metal head wood (No. 1) was attached to a swing robot provided by True Temper. Each golf ball was struck at a head speed of 45 m/second against a target. The evaluation method measured the number of hits until the golf ball broke, assumed that Comparative Example 1 of the same structure was 100 to provide a relative value, and made comparison between those with and without voids in the same structure. The larger the value, the better the durability becomes.

(3) Carry Performance

A metal head wood (No. 1) was attached to a swing robot of True Temper. Each golf ball was struck at a head speed of 40 m/sec. in order to measure the shot angle and back spin rate immediately after the shot, the distance until landing (carry), and the distance to the point at which the ball stopped (total carry). Five measurements were made for each golf ball to determine their mean value.

(4) Feel of Impact Upon Shot

The ball was hit by 10 golfers using a metal head wood (No. 1) driver to evaluate the impact when the ball was hit according to the following criterias:

◎: soft and light; and

×: hard and heavy.

<Evaluation Result>

Comparative Examples 1–5 do not have voids, and exhibit a poor feel and carry. Comparative Example 6 has an excessive number of voids formed in the intermediate layer and exhibits a poor feel, durability and carry. Comparative Example 7 has an insufficient number of voids formed in the intermediate layer, resulting in a poor feel and carry.

Examples 1–9 have voids in the intermediate layer, thereby providing in general an excellent feel, durability and carry. Example 10 has voids in the cover layer, again providing an excellent feel, durability and carry in general.

The golf ball according to the present invention has voids in at least one of the outer layer of the core, the intermediate layer and the cover, thereby providing an excellent feel, durability and carry in general.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A multi-piece golf ball comprising: a core; an intermediate layer surrounding said core; and a cover surrounding said intermediate layer, wherein 20 to 600 voids are distributed in at least one of said core, said intermediate layer or said cover along a spherical surface thereof, wherein each void has a volume of 0.75 to 6 $mm^3$.

2. A multi-piece golf ball comprising: a core; an intermediate layer surrounding said core; and a cover surrounding said intermediate layer, wherein 20 to 600 voids are distributed in at least one of said intermediate layer or said cover along a spherical surface of said intermediate layer or said cover, wherein each void has a volume of 0.75 to 6 $mm^3$.

3. The multi-piece golf ball according to claim 1 or 2, wherein 20 to 550 voids are present.

4. The multi-piece golf ball according to claim 1 or 2, wherein the voids have a total volume of 0.5 to 50% with respect to a volume of the intermediate layer or the cover with the voids.

5. The multi-piece golf ball according to claim 1 or 2, wherein the intermediate layer or the cover with the voids has a thickness of 0.5 to 5 mm.

6. A method for manufacturing the multi-piece golf ball comprising: a core; an intermediate layer surrounding said core; and a cover surrounding said intermediate layer, wherein 20 to 600 voids are distributed in at least one of said core, said intermediate layer or said cover along a spherical surface thereof, wherein each void has a volume of 0.75 to 6 $mm^3$, wherein the method comprises the steps of: molding a half shell of the intermediate layer with gaps formed on its inner surface by using a mold with projections on its spherical surface; and molding an assembly of the core and the intermediate layer by covering the core with a pair of the half shells.

7. The method according to claim 6, wherein the step of molding the assembly of the core and the intermediate layer by covering the core with the pair of the half shells includes press-molding at a temperature of 100 to 140° C. under a pressure of 0.1 to 20 $kg/cm^2$.

8. A method for manufacturing the multi-piece golf ball comprising: a core; an intermediate layer surrounding said core; and a cover surrounding said intermediate layer, wherein 20 to 600 voids are distributed in at least one of said intermediate layer or said cover along a spherical surface of said intermediate layer or said cover, wherein each void has a volume of 0.75 to 6 $mm^3$, wherein the method comprises the steps of: molding a half shell of the intermediate layer with gaps formed on its inner surface by using a mold with projections on its spherical surface; and molding an assembly of the core and the intermediate layer by covering the core with a pair of the half shells.

9. The method according to claim 8, wherein the step of molding the assembly of the core and the intermediate layer by covering the core with the pair of the half shells includes press-molding at a temperature of 100 to 140° C. under a pressure of 0.1 to 20 $kg/cm^2$.

10. The multi-piece golf ball according to claim 1 or 2, wherein the total volume of the voids is 0.5–50% with respect to the volume of the layer in which the voids are formed.

11. The multi-piece golf ball according to claim 1 or 2, wherein 50 to 400 voids are present.

12. The multi-piece golf ball according to claim 1 or 2, wherein the ratio of the total volume of the voids to the volume of the layer with the voids is 0.8–40%.

13. The multi-piece golf ball according to claim 1 or 2, wherein the layer with voids has a Shore D hardness of 70 or less and a JIS-C hardness of 20 or more.

* * * * *